US009075332B1

(12) United States Patent
McGuire et al.

(10) Patent No.: US 9,075,332 B1
(45) Date of Patent: Jul. 7, 2015

(54) SEMI-CONTACT BIAS CHARGE ROLLER

(71) Applicant: Xerox Corporation, Norwalk, CT (US)

(72) Inventors: Gregory Michael McGuire, Oakville (CA); Yu Liu, Mississauga (CA); Johann Junginger, Toronto (CA); Vladislav Skorokhod, Concord (CA); Sarah Jane Vella, Milton (CA); Simon C. Burke, Burlington (CA)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 14/168,214

(22) Filed: Jan. 30, 2014

(51) Int. Cl.
*G03G 15/02* (2006.01)
*G03G 15/00* (2006.01)

(52) U.S. Cl.
CPC ..... *G03G 15/0233* (2013.01); *G03G 15/0216* (2013.01)

(58) Field of Classification Search
CPC ..... G03G 15/0216; G03G 15/0233
USPC ..... 399/176
See application file for complete search history.

(56) References Cited

U.S. PATENT DOCUMENTS

| | | | | |
|---|---|---|---|---|
| 8,849,160 | B2 * | 9/2014 | Liu et al. | 399/176 |
| 8,897,675 | B2 * | 11/2014 | Liu et al. | 399/176 |
| 2011/0292149 | A1 * | 12/2011 | Hara | 347/104 |

* cited by examiner

*Primary Examiner* — David Gray
*Assistant Examiner* — Michael Harrison
(74) *Attorney, Agent, or Firm* — Hoffman Warnick LLC

(57) ABSTRACT

There is described an a bias charge roller including an electrically conductive core and an outer layer axially supported on the core. The outer layer includes a continuous raised pattern above a non-contact surface wherein the continuous raised pattern includes a contact surface having a height of from about 10 microns to about 40 microns above the non-contact surface. The outer layer transitions from the contact surface to the non-contact surface over a minimum linear distance of 100 microns or greater. The contact surface is configured to contact a charge-retentive surface of an electrophotographic imaging member so as to charge the charge-retentive surface.

20 Claims, 3 Drawing Sheets

SEMI-CONTACT BIAS CHARGE ROLLER

BACKGROUND

1. Field of Use

The present disclosure is directed to a bias charge roller that can be employed in an electrophotographic printing machine, photocopier, or a facsimile machine.

2. Background

In electrophotography or electrophotographic printing, the charge retentive surface, typically known as a photoreceptor (P/R), is electrostatically charged, and then exposed to a light pattern of an original image to selectively discharge the surface in accordance therewith. The resulting pattern of charged and discharged areas on the photoreceptor form an electrostatic charge pattern, known as a latent image, conforming to the original image. The latent image is developed by contacting it with a finely divided electrostatically attractable powder known as toner. Toner is held on the image areas by the electrostatic charge on the photoreceptor surface. Thus, a toner image is produced in conforming to a light image of the original being reproduced or printed. The toner image may then be transferred to a substrate or support member (e.g., paper) directly or through the use of an intermediate transfer member, and the image affixed thereto to form a permanent record of the image to be reproduced or printed. Subsequent to development, excess toner left on the charge retentive surface is cleaned from the surface. The process is useful for light lens copying from an original or printing electronically generated or stored originals such as with a raster output scanner (ROS), where a charged surface may be imagewise discharged in a variety of ways.

The described electrophotographic copying process is well known and is commonly used for light lens copying of an original document. Analogous processes also exist in other electrophotographic printing applications such as, for example, digital laser printing and reproduction where charge is deposited on a charge retentive surface in response to electronically generated or stored images.

To charge the surface of a photoreceptor, a contact type charging device has been used; however, contact type charging devices increase wear on the photoreceptor surface and decrease the life of a photoreceptor. The contact type charging device, also termed "bias charge roll" (BCR) includes a conductive member which is supplied a voltage from a power source with a direct current (D.C.) voltage superimposed with an alternating current (A.C.) voltage of no less than twice the level of the D.C. voltage. The charging device contacts the image bearing member (photoreceptor) surface, which is a member to be charged. The contact type charging device charges the image bearing member to a predetermined potential.

Electrophotographic photoreceptors can be provided in a number of forms. For example, the photoreceptors can be a homogeneous layer of a single material, such as vitreous selenium, or it can be a composite layer containing a photoconductive layer and another material. In addition, the photoreceptor can be layered. Multilayered photoreceptors or imaging members have at least two layers, and may include a substrate, a conductive layer, an optional undercoat layer (sometimes referred to as a "charge blocking layer" or "hole blocking layer"), an optional adhesive layer, a photogenerating layer (sometimes referred to as a "charge generation layer," "charge generating layer," or "charge generator layer"), a charge transport layer, and an optional overcoating layer in either a flexible belt form or a rigid drum configuration. In the multilayer configuration, the active layers of the photoreceptor are the charge generation layer (CGL) and the charge transport layer (CTL). Enhancement of charge transport across these layers provides better photoreceptor performance. Multilayered flexible photoreceptor members may include an anti-curl layer on the backside of the substrate, opposite to the side of the electrically active layers, to render the desired photoreceptor flatness.

To further increase the service life of the photoreceptor, use of overcoat layers has also been implemented to protect photoreceptors and improve performance, such as wear resistance. However, these low wear overcoats are associated with poor image quality due to A-zone deletion in a humid environment as the wear rates decrease to a certain level. In addition, high torque associated with low wear overcoats in A-zone also causes severe issues with BCR charging systems, such as motor failure, blade damage and contamination on the BCR and the photoreceptor. As a result, use of a low wear overcoat with BCR charging systems is still a challenge, and there is a need to find ways to increase the life of the photoreceptor.

SUMMARY

Disclosed herein is a bias charge roller including an electrically conductive core and an outer layer axially supported on the electrically conductive core. The outer layer includes a continuous raised pattern above a non-contact surface wherein the continuous raised pattern includes a contact surface having a height of from about 10 microns to about 40 microns above the non-contact surface. The outer layer transitions from the contact surface to the non-contact surface over a minimum linear distance of 100 microns or greater. The contact surface is configured to contact a charge-retentive surface of an electrophotographic imaging member so as to charge the charge-retentive surface.

Disclosed herein is an image forming apparatus. The image forming apparatus includes comprising an electrophotographic imaging member having a charge retentive surface configured to receive an electrostatic latent image. The image forming apparatus includes a development component to apply a developer materials to the charge-retentive surface to form a developed image on the charge-retentive surface. The image forming apparatus includes a transfer component for transferring the developed image from the charge-retentive surface to a substrate and a bias charge roller positioned proximate the charge-retentive surface. The bias charge roller includes an electrically conductive core and an outer layer axially supported on the core. The outer layer includes a continuous raised pattern above a non-contact surface wherein the continuous raised pattern includes a contact surface having a height of from about 10 microns to about 40 microns above the non-contact surface. The outer layer transitions from the contact surface to the non-contact surface over a minimum linear distance of 100 microns or greater. The continuous raised pattern is configured to contact the charge-retentive surface.

Disclosed herein is an image forming apparatus. The image forming apparatus includes an electrophotographic imaging member having a charge retentive surface configured to receive an electrostatic latent image. The image forming apparatus includes a development component to apply developer material to the charge retentive surface to form a developed image on the charge retentive surface. The image forming apparatus includes a transfer component for transferring the developed image from the charge retentive surface to a substrate. The image forming apparatus includes a bias charge roller for applying an electrostatic charge on the charge retentive surface to a predetermined electric potential. The bias charge roller includes an electrically conductive core and an outer layer axially supported on the core. The outer layer includes a continuous raised pattern above a non-contact surface wherein the continuous raised pattern includes a contact surface having a height of from about 10 microns to about 40 microns above the non-contact surface, wherein the outer layer transitions from the contact surface to the non-contact surface over a minimum linear distance of 100 microns or greater. The continuous raised pattern is configured to contact the charge-retentive surface.

It should be noted that some details of the figures have been simplified and are drawn to facilitate understanding of the embodiments rather than to maintain strict structural accuracy, detail, and scale.

DESCRIPTION OF THE EMBODIMENTS

In the following description, reference is made to the chemical formulas that form a part thereof, and in which is shown by way of illustration specific exemplary embodiments in which the present teachings may be practiced. These embodiments are described in sufficient detail to enable those skilled in the art to practice the present teachings and it is to be understood that other embodiments may be utilized and that changes may be made without departing from the scope of the present teachings. The following description is, therefore, merely exemplary.

Notwithstanding that the numerical ranges and parameters setting forth the broad scope of the disclosure are approximations, the numerical values set forth in the specific examples are reported as precisely as possible. Any numerical value, however, inherently contains certain errors necessarily resulting from the standard deviation found in their respective testing measurements. Moreover, all ranges disclosed herein are to be understood to encompass any and all sub-ranges subsumed therein. For example, a range of "less than 10" can include any and all sub-ranges between (and including) the minimum value of zero and the maximum value of 10, that is, any and all sub-ranges having a minimum value of equal to or greater than zero and a maximum value of equal to or less than 10, e.g., 1 to 5. In certain cases, the numerical values as stated for the parameter can take on negative values. In this case, the example value of range stated as "less than 10" can assume negative values, e.g. −1, −2, −3, −10, −20, −30, etc.

Figure 1:
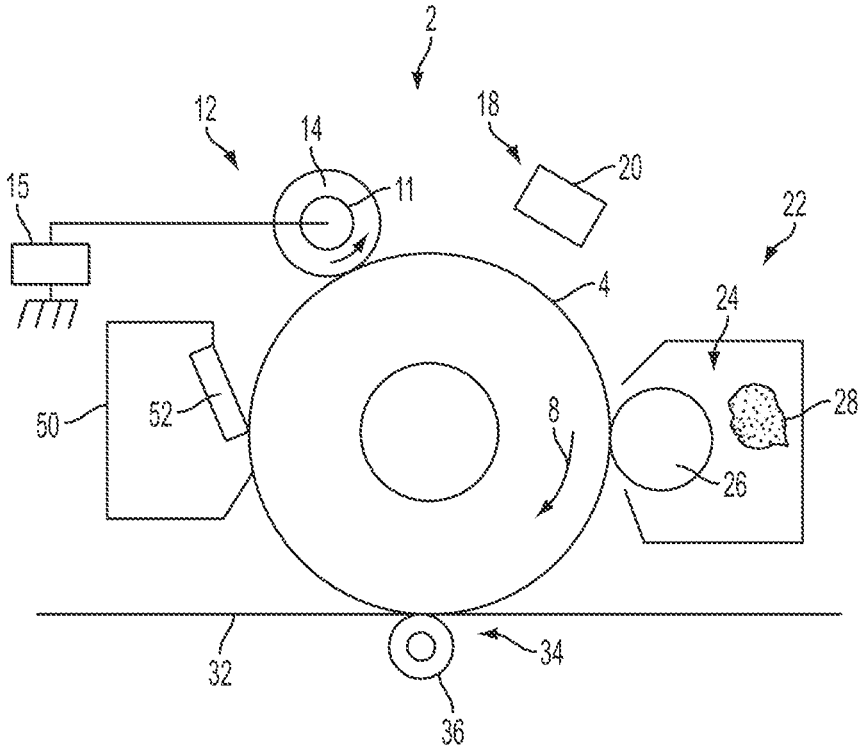
FIG. 1 schematically depicts the various components of an image forming apparatus incorporating a bias charge roller, according to an embodiment of the present disclosure.

FIG. 1 schematically depicts the various components of an electrophotographic imaging apparatus 2 incorporating a bias charge roller 14, according to an embodiment of the present disclosure, as will be discussed in greater detail below. The imaging apparatus 2 can be used in, for example, an electrophotographic printing machine, photocopier or facsimile machine. The bias charge roller 14 of the present disclosure is well suited for use in a wide variety of imaging apparatus and is not limited to the particular design of FIG. 1.

The imaging apparatus 2 employs an electrophotographic imaging member 4 having a charge-retentive surface, or photoreceptor, for receiving an electrostatic latent image. The electrophotographic imaging member or photoreceptor 4 can be in the form of a photoconductive drum as shown in FIG. 1, although imaging members in the form of a belt are also known, and may be substituted therefore. The photoreceptor 4 can rotate in the direction of arrow 8 to advance successive portions thereof sequentially through various processing stations disposed about the path of movement thereof.

Initially, successive portions of photoreceptor 4 pass through charging station 12. At charging station 12, bias charge roller 14 charges the photoreceptor 4 to a uniform electrical potential. Power to the bias charge roller 14 can be supplied by a suitable power control means. As will be described in greater detail below an electrically conductive, continuous raised pattern is positioned on the outer surface of the bias charge roller 14. The bias charge roller 14 includes a metal core 11 to which a power supply unit 15 supplies DC (direct current) and AC (alternating current) biases both of which are constant-voltage-controlled. The DC and AC biases, however, may be constant-current-controlled.

After rotating through charging station 12, the photoreceptor 4 passes through an imaging station 18. Imaging station 18 can employ a suitable photo imaging technique to form an electrostatic latent image on the surface of photoreceptor 4. Any suitable imaging technique can be employed. One example of a well known imaging technique employs a ROS (Raster Optical Scanner) 20. The ROS 20 may include a laser for radiating the photoreceptor 4 to form the electrostatic latent image thereon.

In an embodiment, the imaging apparatus 2 may be a light lens copier. In a light lens copier a document to be reproduced can be placed on a platen located at the imaging station. The document can be illuminated in a known manner by a light source, such as a tungsten halogen lamp. The document thus exposed is imaged onto the photoreceptor 4 in any suitable manner, such as by using a system of mirrors, as is well known in the art. The optical image selectively discharges the photoreceptor 4 in an image configuration, whereby an electrostatic latent image of the original document is recorded on the photoreceptor 4 at the imaging station.

Following imaging station 18, photoreceptor 4 rotates though a development station 22. At development station 22, a developer unit 24 advances developer materials into contact with the electrostatic latent image to thereby develop the image on the photoreceptor 4. The developer unit 24 can include a developer roller 26 mounted in a housing. The developer roller 26 advances developer materials 28 into contact with the latent image. Any suitable developer materials can be employed, such as toner particles. Appropriate developer biasing may be accomplished via a power supply (not shown), electrically connected to developer unit 24, as is well known in the art.

A substrate 32, which can be, for example, a sheet of paper or a surface of an intermittent transfer belt, is moved into contact with the toner image at transfer station 34. Transfer station 34 transfers the developer material image from the photoreceptor 4 to substrate 32. Any suitable transfer technique can be employed for accomplishing this task. For example, transfer station 34 can include a second bias charge roller 36, which applies ions of a suitable polarity onto the backside of substrate 32. This attracts the developer material image from the photoreceptor 4 to substrate 32.

After the image is transferred to substrate 32, the residual developer material 28 carried by image and non-image areas on the photoconductive surface of the imaging member can be removed at cleaning station 50. Any technique for cleaning the photoconductive surface can be employed. For example, a cleaning blade 52 can be disposed at the cleaning station 50 to remove any residual developer material remaining on the photoconductive surface.

It is believed that the foregoing description is sufficient for purposes of the present disclosure to illustrate the general operation of an imaging apparatus as used in an electrophotographic printing machine incorporating the development apparatus of the present invention therein.

Bias Charge Rollers (BCRs) have been used as the major charging apparatus in xerographic systems. At present, most BCRs are in direct contact with the photoreceptor but some manufacturers use a non-contact type. The contact BCR suffers from waste toner contamination over many print cycles and increases the wear rate of the P/R, reducing overall service life of BCR. The non-contact BCR addresses these issues but demands other engineering trade-offs, such as unstable charging uniformity with less robust gap control over the entire service life of the BCR and significantly increased AC voltage which increases the wear rate of P/R.

As described in U.S. Ser. No. 13/566,541 and U.S. Ser. No. 13/850,631, incorporated in their entirety by reference herein, semi-contact bias charge rollers are described.

Figure 2:
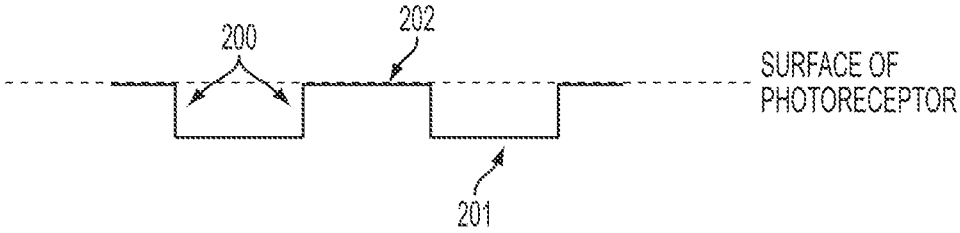
FIG. 2 PRIOR ART
FIG. 2 is a sectional view of a bias charge roller of the prior art.

FIG. 2 shows a sectional view of semi-contact BCR tread design described in U.S. Ser. No. 13/566,541 and U.S. Ser. No. 13/850,631 with abrupt transitions 200 between non-contact areas 201 and contact areas 202 of the BCR with the photoreceptor surface. It is has been observed that sharp transitions between the non-contact areas 201 and contact areas 202 of the BCR produce spotting, edge defects, lines, slight differences in halftone and other non-uniformities that are visible on the print.

Disclosed herein is a semi-contact BCR where the transition between the contact and non-contact surfaces or areas is gradual (e.g. forming a slope). Such a configuration minimizes edge defects and halftone anomalies in prints. Furthermore the depth of the non-contact area (i.e., the maximum gap between the PR surface and the surface of the non-contact portion of the semi-contact BCR) can be made small enough to prevent toner transfer due to failure of the non-contact areas to charge the PR surface to the proper surface potential. This combination of a gradual transition between non-contact and contact areas, and a proper height between the non-contact area and the contact area prevents unwanted toner transfer and any visible non-uniformity during printing.

An improved semi-contact BCR comprising a spiral or tread-like outer layer wherein the transition from the contact portion and non-contact portions is gradual and the maximum non-contact area gap distance is from about 10 microns to about 40 microns. Such a configuration prevents localized charging defects, unwanted toner development in non-contact areas, and visible non-uniformities at the transition area between the contact areas and non-contact areas.

Figure 3:
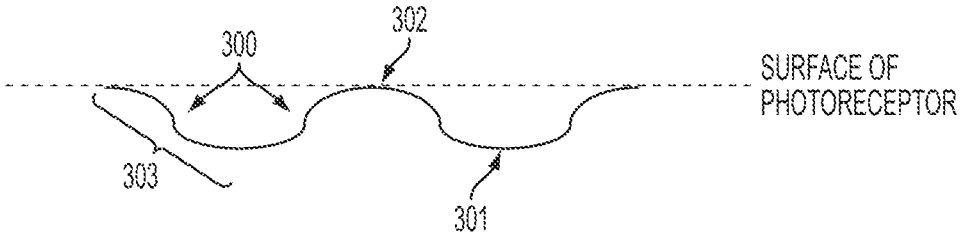
FIG. 3 is a sectional view of a bias charge roller of an embodiment of the present disclosure.

FIG. 3 shows a sectional view of a semi-contact BCR tread design having gradual transitions 300 between non-contact areas 301 and contact areas 302 of the BCR with the photoreceptor surface. The contact area 302 is a continuous raised pattern above the non-contact surfaces wherein the continuous raised pattern and the non-contact surfaces form the outer layer. The continuous raised pattern includes a contact surface having a height of from about 10 microns to about 40 microns above the non-contact surfaces. The contact surfaces 302 are a height of about 10 microns to about 40 microns above the non-contact surfaces 301. In embodiments, contact surfaces 302 are a height of from about 15 microns to about 40 microns, or from about 20 microns to about 40 microns above the non-contact surfaces 301. FIG. 3 shows a transition distance 303, which follows the contour of the outer layer, extending from the contact surfaces 302 to the non-contact surface 301. The minimum linear distance from the contact surface 302 to the non-contact surface 301 is 100 microns or greater. The minimum linear distance determined by measuring the distance from the contact surface 302 to the non-contact surface along the dotted line, i.e. the photoreceptor surface in FIG. 3. In embodiments the minimum linear distance from the contact surface 302 to the non-contact surface 301 is 200 microns or greater or 500 microns or greater In embodiments, the transition distance 303 is the minimum length from the contact surface 302 to the non-contact surface 301 following the outer layer contour. The transition slope is defined as the height the contact surface 302 is above the non-contact surface 301 divided by the transition distance 303 which translates to a slope of 0.1 to about 0.4. Without the gradual transition the slope would be 1.0.

The outer layer is axially supported on the core of the bias charge roller. The outer layer includes a continuous raised pattern above a non-contact surface, wherein the continuous raised pattern includes a contact surface having a height of from about 10 microns to about 40 microns above the non-contact surface, wherein the outer layer includes a transition slope of from about 0.1 to about 0.4 wherein the minimum linear distance along the transition distance 303 as determined along the surface of the photoreceptor is at least 100 microns.

Figure 4A:
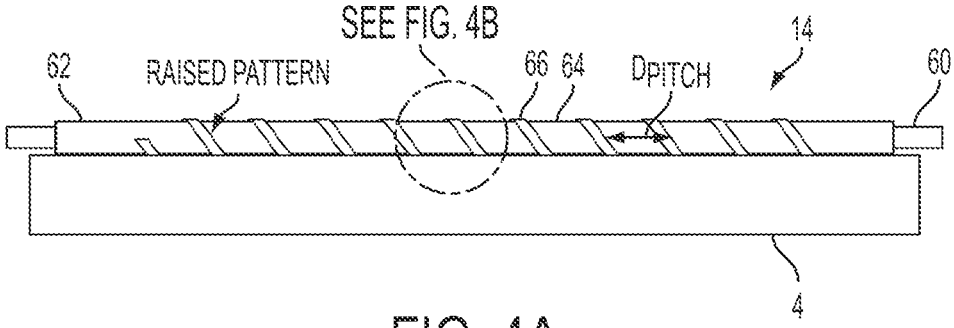
FIGS. 4A and 4B illustrate a semi-contact bias charge roller, according to an embodiment of the present disclosure.
Figure 4B:
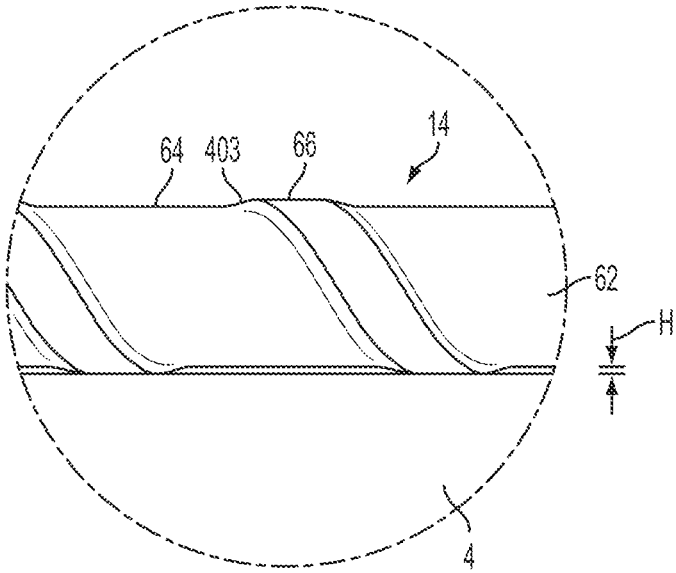

The semi-contact bias charge roller 14 is shown in more detail in FIGS. 4A and 4B. Bias charge roller 14 comprises an electrically conductive core 60. A roller member 62 surrounds the core 60 and is axially supported thereby. The roller member 62 can include one or more coatings configured to provide the desired electrical properties for biasing the photoreceptor 4, including a conductive or semi-conductive outer layer 64 and a raised pattern 66. Raised pattern 66 extends continuously around the longitudinal axis of the bias charge roller 14.

The benefits enabled by disclosed semi-contact BCR design include reduced wear of photoreceptor surface, reduced contamination of BCR and easy integration and implementation.

The height H is the absolute distance between the non-contact surface 64 and the contact surface 66. Using various lathing techniques a transition distance 403 (FIG. 3) is provided between the non-contact surface 64 and the contact surface 66. The minimum linear distance between the contact surface 66 to the non-contact surface is the distance perpendicular to the height H and is 100 microns or greater. For prior art bias rollers the minimum linear distance would be 0. The transition slope is between 0.1 and 0.4. For prior art bias charge rollers, the slope would be 1.0.

The shape of the tread using a lathing technique is controlled by the lathe tool shape. The tools shape can vary from square, pointed (triangle), or rounded (semi-circle) bit. The transition area can be made even more gradual by controlled application of the lathing tool. The shape of the tread using the lathing technique is controlled using the lathe tool shape. The tools shape can vary from square, pointed (triangle), or rounded (semi-circle) bit. The transition area can be made even more gradual by controlled application of the tool.

In an embodiment, the contact surface 66 can wrap around the longitudinal axis of the outer layer. For example, the raised pattern 66 can be wrapped in a coiled configuration, such as in the shape of a helix.

Continuing with the general description of the semi-contact BCR shown in FIGS. 4A and 4B, the conductive core 60 supports the bias charge roller 14, and may generally be made up of any conductive material. Exemplary materials include aluminum, iron, copper, or stainless steel. The shape of the conductive core 60 may be cylindrical, tubular, or any other suitable shape. For the remainder of the discussion, the the non-contact area 64 and the raised pattern 66 make up the outer layer. The raised pattern 66 can be wrapped around the outer layer in a coiled configuration.

The outer layer surrounds conductive core 60 can be deformable to ensure close proximity or contact with the photoreceptor 4. In an alternative embodiment, a stiff, non-conformable outer layer can be employed, as is well known in the art.

Where the outer layer is deformable, the outer layer can be made of any suitable elastomeric polymer material. Examples of suitable polymeric materials include: neoprene, EPDM rubber, nitrile rubber, polyurethane rubber (polyester type), polyurethane rubber (polyether type), silicone rubber, styrene butadiene rubbers, fluoro-elastomers, VITON/FLUOREL rubber, epichlorohydrin rubber, or other similar materials.

The polymeric materials can be mixed with a conductive filler to achieve any desired resistivity. One of ordinary skill in the art would readily be able to determine a suitable resistivity for the non-contact area 64. The amount of conductive filler to achieve a given resistivity may depend on the type of filler employed. As an example, the amount of filler may range from about 1 to about 30 parts by weight per 100 parts by weight of the polymeric material.

Examples of suitable conductive filler include carbon particles, graphite, pyrolytic carbon, metal oxides, ammonium perchlorates or chlorates, alkali metal perchlorates or chlorates, conductive polymers like polyaniline, polypyrrole, polythiophene, and polyacetylene, and the like.

The outer layer may have any suitable thickness. For example, the thickness can range from about 0.1 mm to about 10 mm, such as from about 1 mm to about 5 mm, excluding the thickness of the raised pattern 66.

A low surface energy additive may be included in the outer layer. Examples of low surface energy additives include hydroxyl-containing perfluoropolyoxyalkanes such as FLUOROLINK® D (M.W. of about 1,000 and fluorine content of about 62 percent), FLUOROLINK® D10-H (M.W. of about 700 and fluorine content of about 61 percent), and FLUOROLINK® D10 (M.W. of about 500 and fluorine content of about 60 percent) (—$CH_2OH$); FLUOROLINK® E (M.W. of about 1,000 and fluorine content of about 58 percent) and FLUOROLINK® E10 (M.W. of about 500 and fluorine content of about 56 percent) (—$CH_2(OCH_2CH)_nOH$); FLUOROLINK® T (M.W. of about 550 and fluorine content of about 58 percent), and FLUOROLINK® T10 (M.W. of about 330 and fluorine content of about 55 percent) (—$CH_2OCH_2CH(OH)CH_2OH$); hydroxyl-containing perfluoroalkanes ($R^fCH_2CH_2OH$, wherein $R^f$=$F(CF_2CF_2)_n$) such as ZONYL® BA (M.W. of about 460 and fluorine content of about 71 percent), ZONYL® BA-L (M.W. of about 440 and fluorine content of about 70 percent), ZONYL® BA-LD (M.W. of about 420 and fluorine content of about 70 percent), and ZONYL® BA-N (M.W. of about 530 and fluorine content of about 71 percent); carboxylic acid-containing fluoropolyethers such as FLUOROLINK® C (M.W. of about 1,000 and fluorine content of about 61 percent); carboxylic ester-containing fluoropolyethers such as FLUOROLINK® L (M.W. of about 1,000 and fluorine content of about 60 percent) and FLUOROLINK® L10 (M.W. of about 500 and fluorine content of about 58 percent); carboxylic ester-containing perfluoroalkanes ($R^fCH_2CH_2O(C{=}O)R$, wherein $R^f$=$F(CF_2CF_2)_n$ and R is alkyl) such as ZONYL® TA-N (fluoroalkyl acrylate, R=$CH_2$=CH—, M.W. of about 570 and fluorine content of about 64 percent), ZONYL® TM (fluoroalkyl methacrylate, R=CH2=C(CH3)-, M.W. of about 530 and fluorine content of about 60 percent), ZONYL® FTS (fluoroalkyl stearate, R=$C_{17}H_{35}$, M.W. of about 700 and fluorine content of about 47 percent), ZONYL® TBC (fluoroalkyl citrate, M.W. of about 1,560 and fluorine content of about 63 percent); sulfonic acid-containing perfluoroalkanes ($R^fCH_2CH_2SO_3H$, wherein $R^f$=$F(CF_2CF_2)_n$) such as ZONYL® TBS (M.W. of about 530 and fluorine content of about 62 percent); ethoxysilane-containing fluoropolyethers such as FLUOROLINK® S10 (M.W. of about 1,750 to about 1,950); phosphate-containing fluoropolyethers such as FLUOROLINK® F10 (M.W. of about 2,400 to about 3,100); hydroxyl-containing silicone modified polyacrylates such as BYK-SILCLEAN® 3700; polyether modified acryl polydimethylsiloxanes such as BYK-SILCLEAN® 3710; and polyether modified hydroxyl polydimethylsiloxanes such as BYK-SILCLEAN® 3720. FLUOROLINK® is a trademark of Ausimont, ZONYL® is a trademark of DuPont, and BYK-SILCLEAN® is a trademark of BYK. All percent concentrations listed herein above are percentages by weight of the relevant polymer, unless specified otherwise.

The outer layer can be either conductive or semi-conductive. In an embodiment, the conductivity of the outer layer can be, for example, 100 S/cm or more. The surface resistivity of the outer layer can be any suitable value that will provide good print quality. For example, surface resistivity can range from about $10^3$ ohm-m to about $10^{13}$ ohm-m at 20° C., or from about $10^4$ ohm-m to about $10^{12}$ ohm-m, or from about $10^5$ ohm-m to about $10^7$ ohm-m.

The outer layer may be formed by any suitable conventional technique. Examples of suitable techniques include spraying, dip coating, draw bar coating, gravure coating, silk screening, air knife coating, reverse roll coating, vacuum deposition, chemical treatment, or a molding process.

The raised pattern or contact surface 66, which forms a portion of the outer layer and can be the same or different material from the non-contact surface 64. The raised pattern 66 can be electrically conductive or semi-conductive and can comprise any suitable electrically conductive or semi-conductive material. Examples of suitable materials include metals, such as copper, copper alloys, aluminum, aluminum alloys, or conductive or semi-conductive polymers, such as ultra high molecular weight (UHMW) polyethylene or any of the other elastomers discussed herein for use in the outer layer. Raised pattern 66 can further include conductive fillers and/or low surface energy additives, as also listed above for outer layer.

Raised pattern 66 can be made of the same material or a different material as the non-contact surface 64. In an embodiment, raised pattern or contact surface 66 is formed as an integral part of outer layer, such as by using a molding process that forms both together or a lathing process where the non-contact surface 64 is formed by removing material. In other embodiments, raised pattern 66 can be formed separately from outer layer.

In an embodiment, the raised pattern 66 can wrap around the longitudinal axis of the outer layer. For example, the raised pattern 66 can be wrapped in a coiled configuration, such as in the shape of a helix.

As shown in FIG. 4B, raised pattern 66 has a height, H that above the non-contact surface 64. During operation, the height H operates in a periodically non-contact mode to charge the photoreceptor. H can have any suitable value from about 10 micron to about 40 microns, or about 15 microns to about 40 microns, or about 20 microns to about 400 microns.

Defined herein is a ratio R of the "circumferential coverage (CC)" of contact area 66 and non-contact area 64 of the BCR:

$$R = \frac{CC[\text{Contact}]}{CC[\text{Non-contact}]}$$

where CC[Contact] is the circumferential coverage area of the raised portion (area of 66 in contact with the P/R), and CC[Non-Contact] is the circumferential coverage area of the non-contact area (area of 64).

In operating a semi-contact BCR, correct design of R can minimize contact area (contact time for same speed) with the P/R. It has been determined that too large or too small of an R can result in an increase in the contact area. If the R is too large, it is straightforward to expect too much contact area; however, if the R is too small, the gap between non-contact area and P/R can not be effectively guaranteed. Exemplary R values range from about 0.08 to about 0.3, such as about 0.08 to about 0.2, or about 0.1 to about 0.2 were disclosed in U.S. Ser. No. 13/566,541. However, the effectiveness of charging a P/R surface is also dependent on the direct current and alternating current voltages.

While embodiments have been illustrated with respect to one or more implementations, alterations and/or modifications can be made to the illustrated examples without departing from the spirit and scope of the appended claims. In addition, while a particular feature herein may have been disclosed with respect to only one of several implementations, such feature may be combined with one or more other features of the other implementations as may be desired and advantageous for any given or particular function.

EXAMPLES

Examples 1-3

BCRs were fabricated having a gradual curve between the contact surface and the non-contact surface as shown in FIG. 4 by using a rounded lathe tool with gradual application. The depth was varied from 10 microns to 90 microns. A deep cut was made as a reference point to help line up the print to the BCR after testing. The print tests were carried out in a an X700 printer. Both white and halftone prints were evaluated for uniformity and toner transfer.

It was found that to eliminate unwanted toner transfer under the non-contact portion of the semi-contact BCR the depth of the tread (i.e., gap between PR surface and non-contact portion of the BCR) must be 40 microns or less. With gradual transitions, that is, the minimum linear distance between the contact surface and the non-contact surface was greater than 100 microns and there was no visible non-uniformity in the printed image.

It will be appreciated that variants of the above-disclosed and other features and functions or alternatives thereof, may be combined into other different systems or applications. Various presently unforeseen or unanticipated alternatives, modifications, variations, or improvements therein may be subsequently made by those skilled in the art which are also encompassed by the following claims.

What is claimed is:

1. A bias charge roller comprising:

an electrically conductive core;

an outer layer axially supported on the core, wherein the outer layer includes a continuous raised pattern above a non-contact surface wherein the continuous raised pattern includes a contact surface having a height of from about 10 microns to about 40 microns above the non-contact surface, wherein the outer layer transitions from the contact surface to the non-contact surface over a minimum linear distance of 100 microns or greater wherein the contact surface is configured to contact a charge-retentive surface of an electrophotographic imaging member so as to charge the charge-retentive surface.

2. The bias charge roller of claim 1, wherein the continuous raised pattern wraps externally around the outer layer along a longitudinal axis of the outer layer.

3. The bias charge roller of claim 1, wherein a circumferential coverage ratio is defined as:

$$R = \frac{CC[\text{Contact}]}{CC[\text{Non-contact}]}$$

wherein CC[Contact] is a circumferential coverage area of the contact surface of the bias charge roller, and CC[Non-contact] is a circumferential coverage area for a non-contact surface of the bias charge roller, and wherein R ranges from about 0.08 to about 0.3, and wherein the outer layer is either conductive or semi-conductive.

4. The bias charge roller of claim 1, wherein the bias charge roller comprises only one continuous raised pattern.

5. The bias charge roller of claim 1, wherein the continuous raised pattern is spiral shaped.

6. The bias charge roller of claim 1, wherein the continuous raised pattern comprises a material selected from the group consisting of conductive materials and semi-conductive materials.

7. An image forming apparatus comprising:

an electrophotographic imaging member having a charge retentive surface configured to receive an electrostatic latent image;

a development component to apply a developer materials to the charge-retentive surface to form a developed image on the charge-retentive surface;

a transfer component for transferring the developed image from the charge-retentive surface to a substrate; and a bias charge roller positioned proximate the charge-retentive surface, the bias charge roller comprising:

an electrically conductive core;

an outer layer axially supported on the core, wherein the outer layer includes a continuous raised pattern above a non-contact surface wherein the continuous raised pattern includes a contact surface having a height of from about 10 microns to about 40 microns above the non-contact surface, wherein the outer layer transitions from the contact surface to the non-contact surface over a minimum linear distance of 100 microns or greater, wherein the continuous raised pattern is configured to contact a charge-retentive surface.

8. The image forming apparatus of claim 7, wherein a circumferential coverage ratio is defined as:

$$R = \frac{CC[\text{Contact}]}{CC[\text{Non-contact}]}$$

wherein CC[Contact] is a circumferential coverage area of the continuous raised pattern of the bias charge roller, and CC[Non-contact] is a circumferential coverage for a non-contact surface of the bias charge roller, and wherein R ranges from about 0.08 to about 0.3.

9. The image forming apparatus of claim 7, wherein the continuous raised pattern wraps around a longitudinal axis of the bias charge roller.

10. The image forming apparatus of claim 7, wherein the continuous raised pattern is positioned over a center region of a longitudinal axis of the bias charge roller.

11. The image forming apparatus of claim 7, wherein the continuous raised pattern is spiral shaped.

12. The image forming apparatus of claim 7, wherein the continuous raised pattern comprises a material selected from the group consisting of from metals and conductive polymers.

13. The image forming apparatus of claim 7, wherein the continuous raised pattern comprises a metal selected from the group consisting of copper, copper alloy, aluminum and aluminum alloy.

14. The image forming apparatus of claim 7, wherein the image forming apparatus is a photoconductive belt.

15. The image forming apparatus of claim 7, wherein the image forming apparatus is a photoconductive drum.

16. An image forming apparatus comprising:

an electrophotographic imaging member having a charge retentive surface configured to receive an electrostatic latent image;

a development component to apply developer material to the charge retentive surface to form a developed image on the charge retentive surface;

a transfer component for transferring the developed image from the charge retentive surface to a substrate; and a bias charge roller for applying an electrostatic charge on the charge retentive surface to a predetermined electric potential the bias charge roller comprising:

an electrically conductive core;

an outer layer axially supported on the core, wherein the outer layer includes a continuous raised pattern above a non-contact surface wherein the continuous raised pattern includes a contact surface having a height of from about 10 microns to about 40 microns above the non-contact surface, wherein the outer layer transitions from the contact surface to the non-contact surface over a minimum linear distance of 100 microns or greater, wherein the continuous raised pattern is configured the contact a charge retentive surface.

17. The image forming apparatus of claim 16, wherein the continuous raised pattern wraps around a longitudinal axis of the bias charge roller.

18. The image forming apparatus of claim 16, wherein the continuous raised pattern is positioned over a center region of a longitudinal axis of the bias charge roller.

19. The image forming apparatus of claim 16, wherein the continuous raised pattern is spiral shaped.

20. The image forming apparatus of claim 16, wherein the continuous raised pattern comprises a material selected from the group consisting of from metals and conductive polymers.

* * * * *